US009327854B2

(12) United States Patent
Huang

(10) Patent No.: US 9,327,854 B2
(45) Date of Patent: May 3, 2016

(54) VACUUM SEALING MACHINE

(71) Applicant: Mao-Sen Huang, Taichung (TW)

(72) Inventor: Mao-Sen Huang, Taichung (TW)

( * ) Notice: Subject to any disclaimer, the term of this patent is extended or adjusted under 35 U.S.C. 154(b) by 635 days.

(21) Appl. No.: 13/653,904

(22) Filed: Oct. 17, 2012

(65) Prior Publication Data

US 2014/0102051 A1 Apr. 17, 2014

(51) Int. Cl.
*B65B 31/02* (2006.01)
*B65B 31/04* (2006.01)

(52) U.S. Cl.
CPC ..... *B65B 31/024* (2013.01); *B65B 31/048* (2013.01)

(58) Field of Classification Search
CPC ..... B65B 31/024; B65B 31/048
USPC ..... 53/512, 434, 374.9, 375.6
See application file for complete search history.

(56) References Cited

U.S. PATENT DOCUMENTS 3,589,098 A * 6/1971 Schainholz et al. ..... 53/79
4,860,523 A * 8/1989 Teteishi et al. ..... 53/512
5,561,964 A * 10/1996 McIntyre et al. ..... 53/75
5,711,136 A * 1/1998 Carcano ..... 53/434

* cited by examiner

*Primary Examiner* — Xavier A Madison

(57) ABSTRACT

A vacuum sealing machine contains a sealing unit including a first connecting rod, two first electromagnets, and a first press member, the first connecting rod having two fixing pieces and two first apertures, and the first press member having a first adhering face; a pressing unit including a second connecting rod, two second electromagnets, a second press member, and two connection mounts, the second connecting rod having two pull bars, a plurality of second apertures, and two support tabs to support the first connecting rod, and the second press member having a second adhering face; an air exhausting unit including a transmission device and a drawing device; the body having a holder in which a receiving room is formed so as to receive the sealing unit, the pressing unit, and the air exhausting unit; the receiving room having a seat, the seat having the barrier strip and a heating strip.

3 Claims, 8 Drawing Sheets

VACUUM SEALING MACHINE

FIELD OF THE INVENTION

The present invention relates to a sealing machine, and more particularly to a vacuum sealing machine which has an automatic drawing and sealing function.

BACKGROUND OF THE INVENTION

A conventional sealing machine is used to seal a closure bag, but such a conventional sealing machine cannot be used to seal the closure bag in a vacuum state so as to preserve food fresh. Accordingly, a vacuum sealing machine is further developed. However, such a vacuum sealing machine is operated manually and has to be connected with a pneumatic cylinder so as to obtain a power source, thus operating the vacuum sealing machine inconvenience. For example, TW Patent No. M315698 discloses that a vertical moving structure for a sealing machine contains a control seat, a front delivery member, a rear delivery member, a sealing and cutting device, and a film clipping device. The sealing and cutting device is fixed on a movable rack which has at least one fixed mount disposed on for outer sides of the movable rack. The at least one fixed mount is axially mounted on a limiting rod of two opposite positions of two sides of a machine body, and the movable rack has a vertical moving device mounted on two sides of a lower end thereof, the vertical moving device has a pneumatic cylinder with an upper end and a lower end, wherein the upper end of the pneumatic cylinder is fixed on the machine body, and the lower end of the pneumatic cylinder is connected with a support post, the support post has two ends disposed on the movable rack. The machine body has a control handle for being rotated to control a vertical movement of the pneumatic cylinder, such that the movable rack is driven to move upwardly and downwardly so that the sealing and cutting device is moved adjustably. Due to the pneumatic cylinder is a power source so as to drive the sealing machine, it has to be connected with an air compressor, thus operating the sealing machine complicatedly and costly.

The present invention has arisen to mitigate and/or obviate the afore-described disadvantages.

SUMMARY OF THE INVENTION

The primary object of the present invention is to provide a vacuum sealing machine which allows providing excitation suction to draw air in a closure bag in a vacuum state and to seal the closure bag automatically, thus simplifying sealing process.

Another of the present invention is to provide a vacuum sealing machine which has a first connecting rod connecting with a first press member and a second connecting rod coupling with a second press member so as to operate air drawing process and the sealing process separately, thus isolating air excellently.

To obtain the above objective, a vacuum sealing machine provided by the present invention contains a sealing unit, a pressing unit, an air exhausting unit, and a body.

The sealing unit includes a first connecting rod, two first electromagnets, and a first press member. The first connecting rod is formed in a C shape and has two fixing pieces extending outwardly from two sides thereof, the first connecting rod also has two first apertures defined on two rear ends of the two sides thereof, when the two first electromagnets insert into the two fixing pieces, each of the two first electromagnets is fixed on the first connecting rod by ways of a first shaft, and the first press member has a first adhering face defined on a lower end thereof so that the each first electromagnet provides power excitation to attract the first press member downwardly.

The pressing unit includes a second connecting rod, two second electromagnets, a second press member, and two connection mounts. The second connecting rod is formed in a C shape and has two pull bars disposed on two sides thereof and a plurality of second apertures defined on two rear sections of the two sides thereof and corresponding to the two first apertures of the sealing unit. The first connecting rod and the second connecting rod are mounted in the two connection mounts, the second connecting rod also has two support tabs arranged on two inner surfaces of a front end thereof so as to support the first connecting rod of the sealing unit. The pressing unit drives the sealing unit to return an original position by ways of the two support tabs, and the second press member has a second adhering face defined on a lower end thereof so that the each second electromagnet provides power excitation to attract the second press member downwardly.

The air exhausting unit includes a transmission device and a drawing device. The transmission device drives the drawing device to move forwardly or backwardly.

The body has a holder in which a receiving room is formed so as to receive the sealing unit, the pressing unit, and the air exhausting unit, and the receiving room has a seat formed on a front side thereof, and the seat having the barrier strip disposed thereon and a heating strip fixed on an inner side thereof parallel to the barrier strip.

Thereby, when a closure bag is placed on the barrier strip of the seat, thereafter the transmission device is started to drive the drawing device to move into the closure bag, and then the second press member moves downwardly to press the closure bag, and the drawing device draws air in the closure bag, and after drawing the air in the closure bag, the sealing unit seals and adheres the closure bag in a vacuum state, and the pressing unit returns back to an original position and drives the sealing unit to return the original position.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
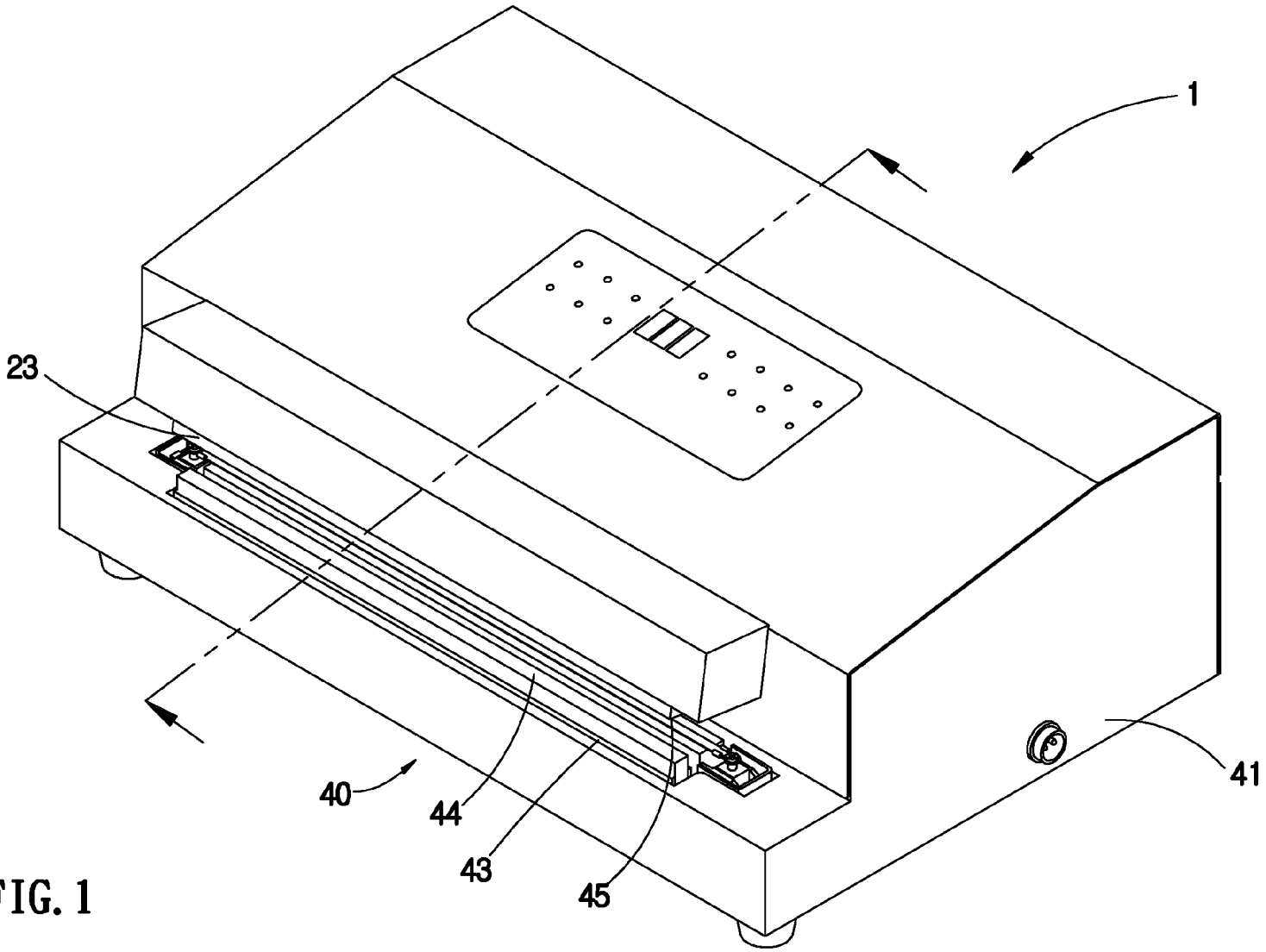
FIG. 1 is a perspective view showing the assembly of a vacuum sealing machine according to a preferred embodiment of the present invention.

With reference to FIGS. 1-8, a vacuum sealing machine 1 according to a preferred embodiment of the present invention comprises a sealing unit 10, a pressing unit 20, an air exhausting unit 30, and a body 40.

Figure 2:
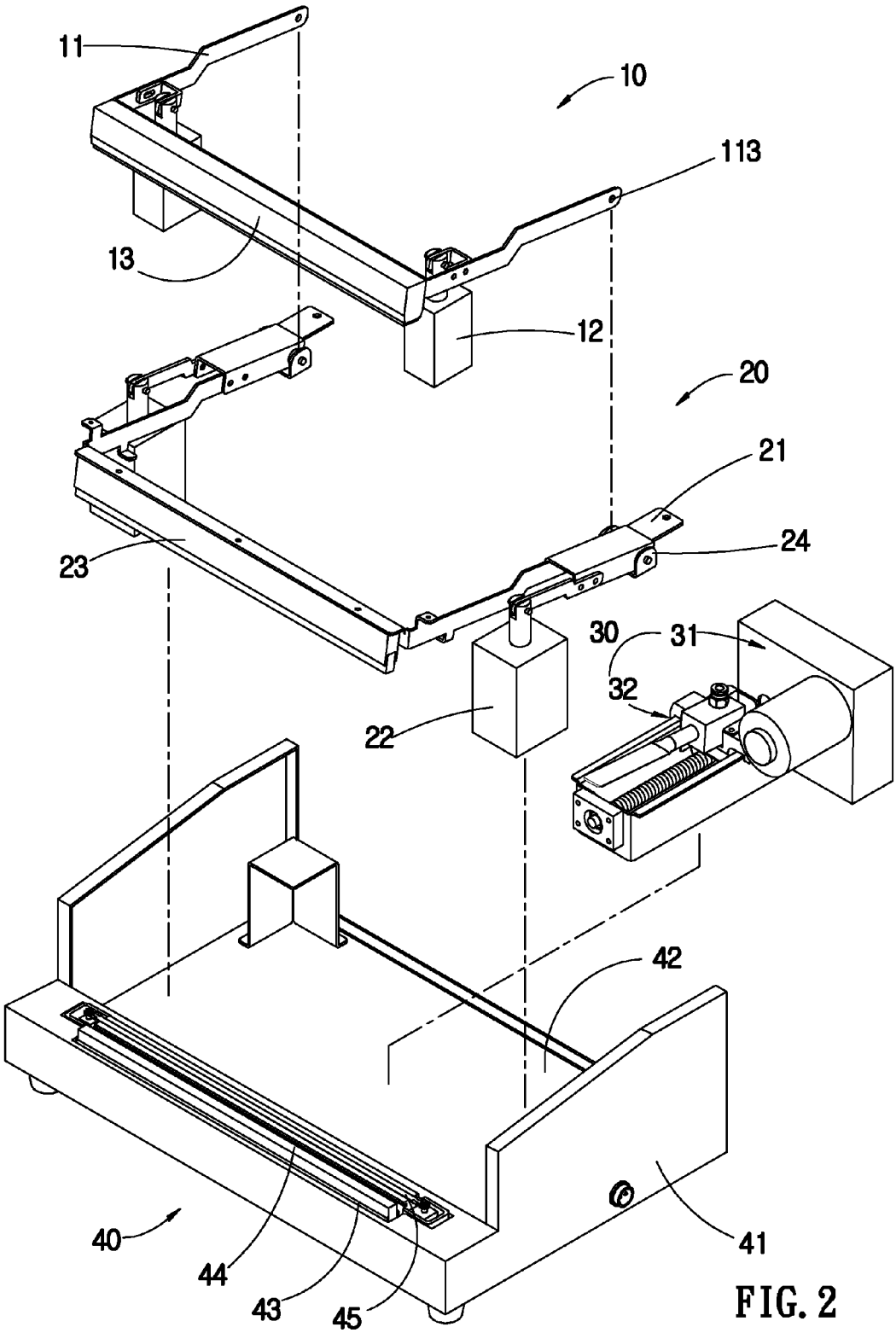
FIG. 2 is a perspective view showing the exploded components of the vacuum sealing machine according to the preferred embodiment of the present invention.
Figure 3:
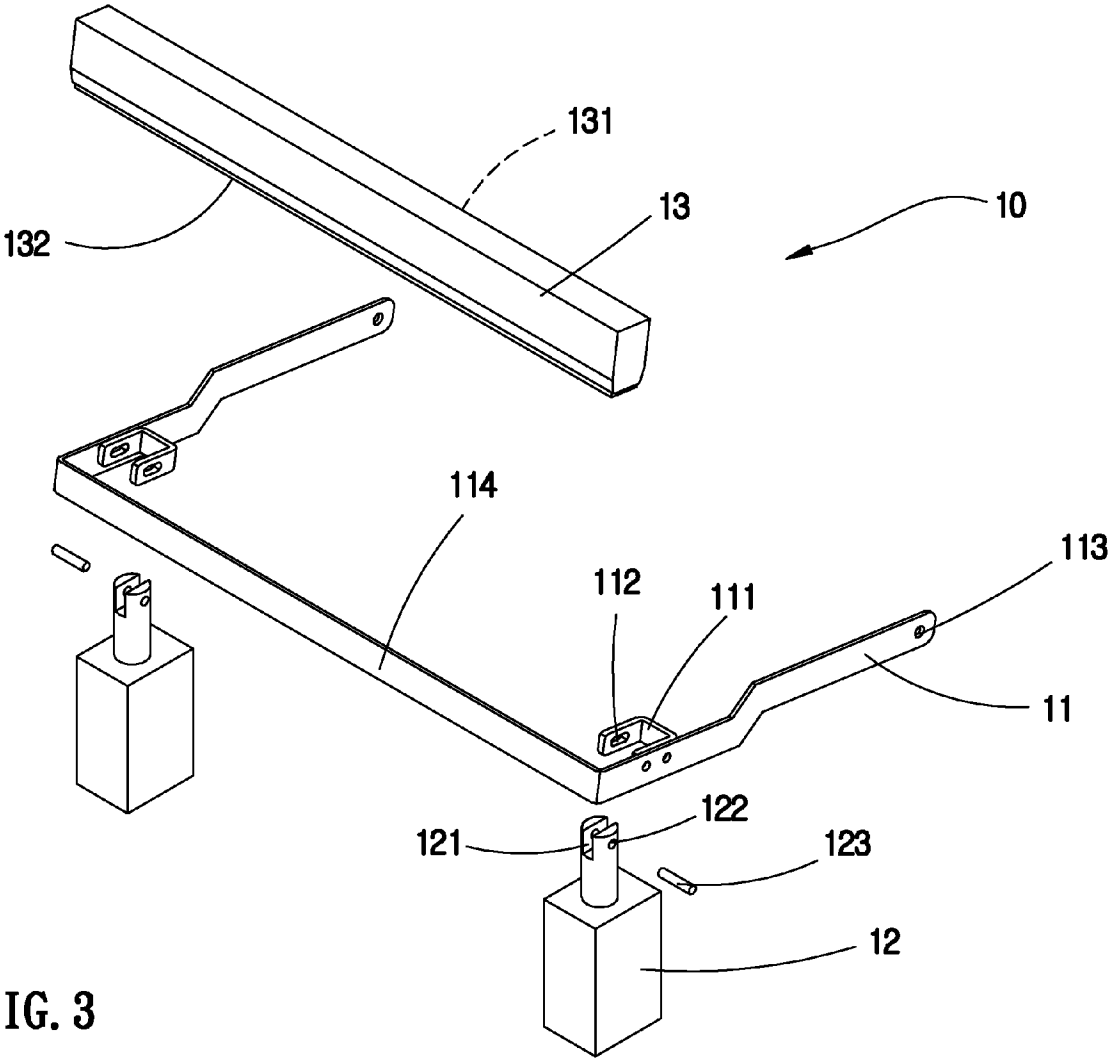
FIG. 3 is a perspective view showing the exploded components of a sealing unit of the vacuum sealing machine according to the preferred embodiment of the present invention.

As shown in FIGS. 2 and 3, the sealing unit 10 includes a first connecting rod 11, two first electromagnets 12, and a first press member 13. The first connecting rod 11 is formed in a C shape and its front end contacts with two support tabs 215 of the pressing unit 20 and has two fixing pieces 111 extending outwardly from two sides thereof so as to position two first recesses 121 of the two first electromagnets 12, such that each first hole 112 of each fixing piece 111 and two first orifices 122 of each first electromagnet 12 are on a horizontal plane, hence the each first electromagnet 12 is fixed on the first connecting rod 11 by ways of a first shaft 123. In addition, the first connecting rod 11 has two first apertures 113 defined on two rear ends of the two sides thereof and a first flat face 114 formed on the front end thereof so as to contact with a first coupling face 131 of the first press member 13, and the first press member 13 has a first adhering face 132 defined on a lower end thereof so that the each first electromagnet 12 provides power excitation to attract the first press member 13 downwardly, hence the first coupling face 131 presses a heating strip 45 of a seat 43 so as to seal an object.

Figure 4:
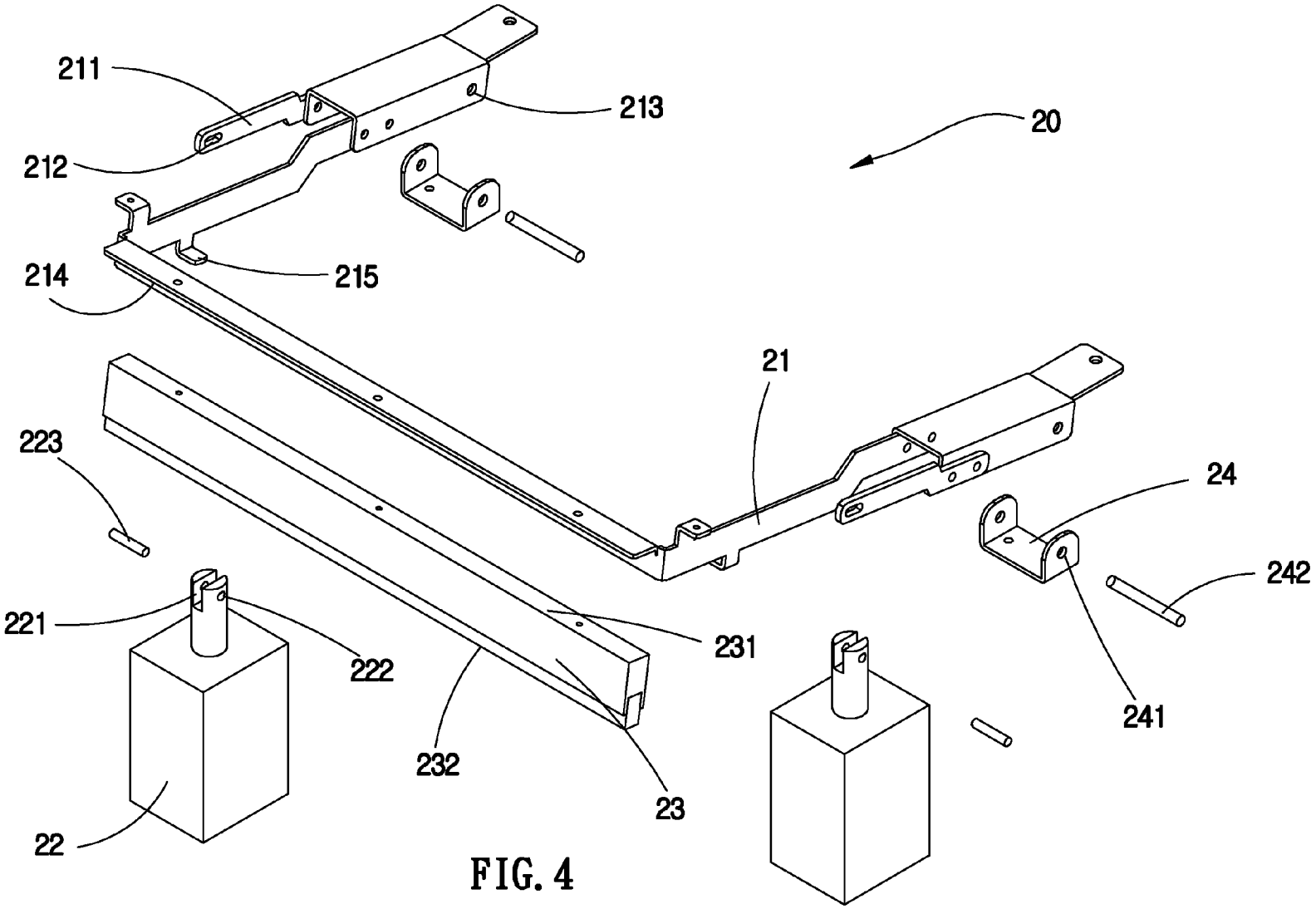
FIG. 4 is a perspective view showing the exploded components of a pressing unit of the vacuum sealing machine according to the preferred embodiment of the present invention.

As illustrated in FIGS. 2 and 4, the pressing unit 20 includes a second connecting rod 21, two second electromagnets 22, a second press member 23, and two connection mounts 24. The second connecting rod 21 is formed in a C shape, and the pressing unit 20 is secured in the body 40 by means of the two connection mounts 24, a diameter of the second connecting rod 21 is larger than that of the first connecting rod 11 so that the first connecting rod 11 is axially fixed in the second connecting rod 21. The second connecting rod 21 has two pull bars 211 disposed on two sides thereof and inserted into two second recesses 221 of the two second electromagnets 22, such that each second hole 212 of each pull bar 211 and two second orifices 222 of each second electromagnet 22 are on a horizontal plane, hence the each second electromagnet 22 is fixed on the second connecting rod 21 by ways of a second shaft 223. In addition, the second connecting rod 21 has a plurality of second apertures 213 defined on two rear sections of the two sides thereof and corresponding to the two first apertures 113 of the first connecting rod 11 of the sealing unit 10. The first connecting rod 11 and the second connecting rod 21 are mounted in the two connection mounts 24, and the two first apertures 113, the plurality of second apertures 213, and two openings 241 of each connection mount 24 are on a horizontal plane. The first connecting rod 11 is axially connected with the second connecting rod 21 by using two third shafts 242 so that the sealing unit 10 is axially fixed in the pressing unit 20. The second connecting rod 21 also has the two support tabs 215 arranged on two inner surfaces of a front end thereof so as to support the first connecting rod 11 of the sealing unit 10, such that the first connecting rod 11 does not fall due to gravity. After the sealing machine seals the object, the pressing unit 20 drives the sealing unit 10 to return an original position by ways of the two support tabs 215, and the second connecting rod 21 further has a second flat face 214 formed on the front end thereof so as to contact with a second coupling face 231 of the second press member 23, and the second press member 23 has a second adhering face 232 defined on a lower end thereof so that the each second electromagnet 22 provides power excitation to attract the second press member 23 downwardly, hence the second coupling face 231 contacts with a barrier strip 44 of the seat 43, and the air exhausting unit 30 draws air so as to draw the air in an closure bag.

Figure 5:
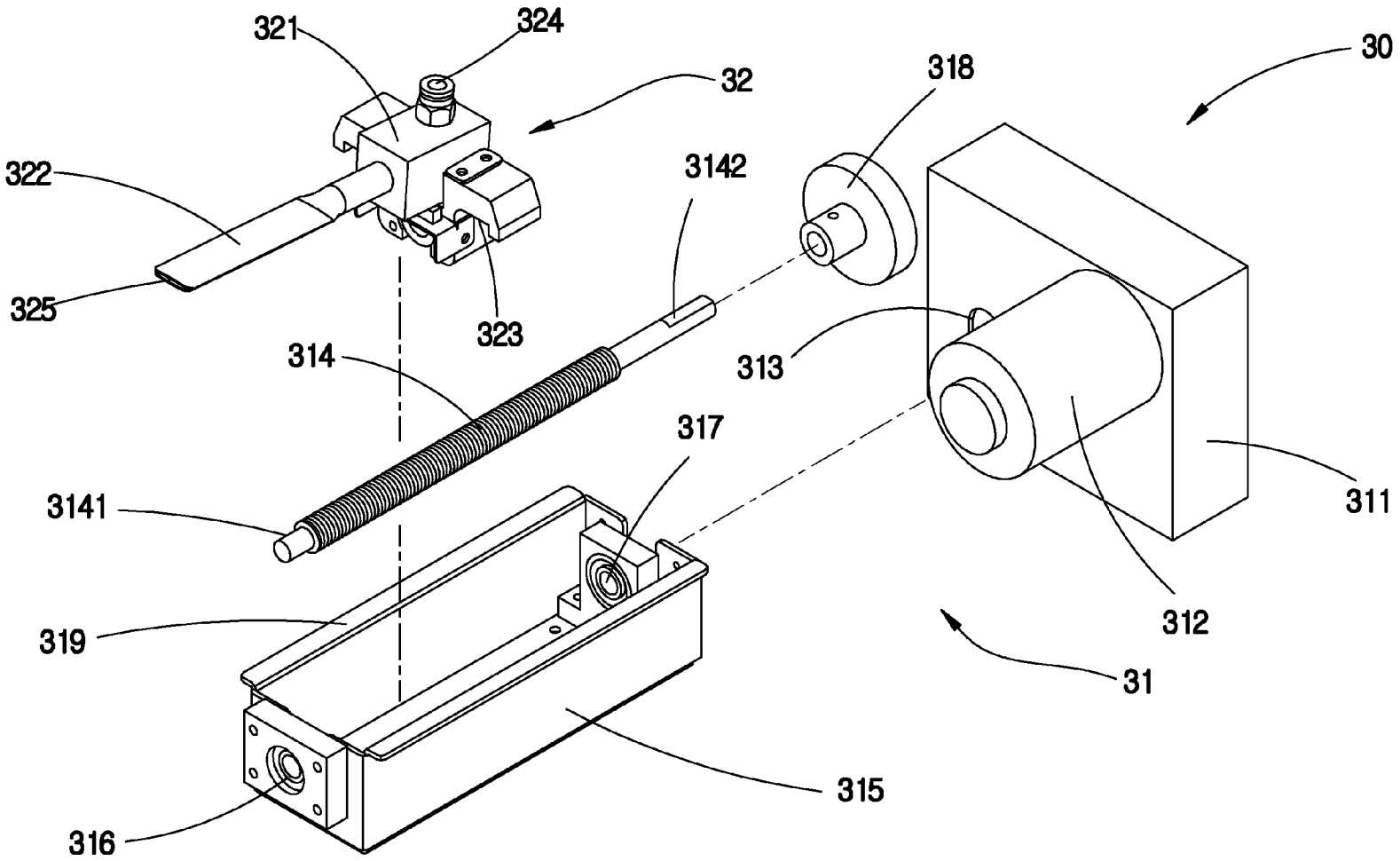
FIG. 5 is a perspective view showing the exploded components of an air exhausting of the vacuum sealing machine according to the preferred embodiment of the present invention.

Referring to FIGS. 2 and 5, the air exhausting unit 30 includes a transmission device 31 and a drawing device 32. The transmission device 31 is comprised of a transmitting portion 311, an electric motor 312, a first bore 313, a driving post 314, a pedestal 315, a second bore 316, a third bore 317, a gear 318, and two rails 319. The transmitting portion 311 has the electric motor 312 disposed therein and the first bore 313 defined beside the electric motor 312 so as to insert the driving post 314. The driving post 314 has a rear segment 3141 formed on one end thereof and inserted into the second bore 316 via the pedestal 315 and has a front segment 3142 inserted into the third bore 317 of the pedestal 315 so that the driving post 314 is axially fixed in the pedestal 315 which is mounted on the transmitting portion 311, and the front segment 3142 of the driving post 314 axially couples with the gear 318 via the first bore 313 so that the transmitting portion 311 is defined between the pedestal 315 and the gear 318. In addition, the pedestal 315 has the two rails 319 parallelly secured thereon and corresponding to two dovetail slots 323 of the drawing device 32. The drawing device 32 is comprised of a stand 321, a suck tube 322, the two dovetail slots 323, an outlet 324, and an intake 325. The stand 321, is axially mounted on the driving post 314, has the suck tube 322 disposed on a front side thereof, has the intake 325 defined on a front end of the suck tube 322, and has the two dovetail slots 323 formed on a lower side thereof and corresponding to the two rails 319 of the transmission device 31. The transmission device 31 is axially fixed on the driving post 314 so that the two dovetail slots 323 defined on the two rails 319, such that the transmission device 31 is reciprocately driven by the driving post 314. The stand 321 also has the outlet 324 defined thereon and connecting with a ventilating device and an air filtration apparatus (not shown). Because the ventilating device and the air filtration apparatus are a well-known art, further remarks are omitted. Thereby, the air in the closure bag is exhausted. Furthermore, the electric motor 312 drives the gear 318 to rotate so that the driving post 314 is driven by the gear 318 to drive the stand 321, and then the stand 321 moves forwardly or backwardly. Thereafter, the suck tube 322 moves forwardly so that the intake 325 inserts into the closure bag, and the two second electromagnets 22 provides the power excitation to generate an attraction force by which the second press member 23 is attracted downwardly, such that the suck tube 322 is retained between the second adhering face 232 and the barrier strip 44, and the intake 325 draws air. When the air is drawn, the drawing device 32 stops operation, and then the first bore 313 drives the drawing device 32 to move inwardly so that the second adhering face 232 contacts with the barrier strip 44. After the two first electromagnets 12 initiate an magnetism, the attraction force produces to drive the first connecting rod 11, and the first press member 13 is attracted downwardly so that the first coupling face 131 of the first press member 13 presses the heating strip 45 of the seat 43 to start a heating and sealing operation, thus sealing and adhering the closure bag in a vacuum state. Moreover, the second connecting rod 21 of the pressing unit 20 has the two support tabs 215 arranged on the two inner surfaces of the front end thereof so as to support the first connecting rod 11 of the sealing unit 10, such that when the pressing unit 20 returns back to an original position, the sealing unit 10 is driven by the pressing unit 20 so as to return back to the original position.

As shown in FIG. 2, the body 40 has a holder 41 in which a receiving room 42 is formed so as to receive the sealing unit 10, the pressing unit 20, and the air exhausting unit 30. The receiving room 42 has the seat 43 formed on a front side thereof, and the seat 43 has the barrier strip 44 disposed thereon and contacts with the second adhering face 232 of the second press member 23 so as to stop air. The seat 43 also has the heating strip 45 fixed on an inner side thereof parallel to the barrier strip 44, and the heating strip 45 is relative to the first adhering face 132 of the first press member 13 of the sealing unit 10 so as to have the heating and sealing operation.

Figure 6:
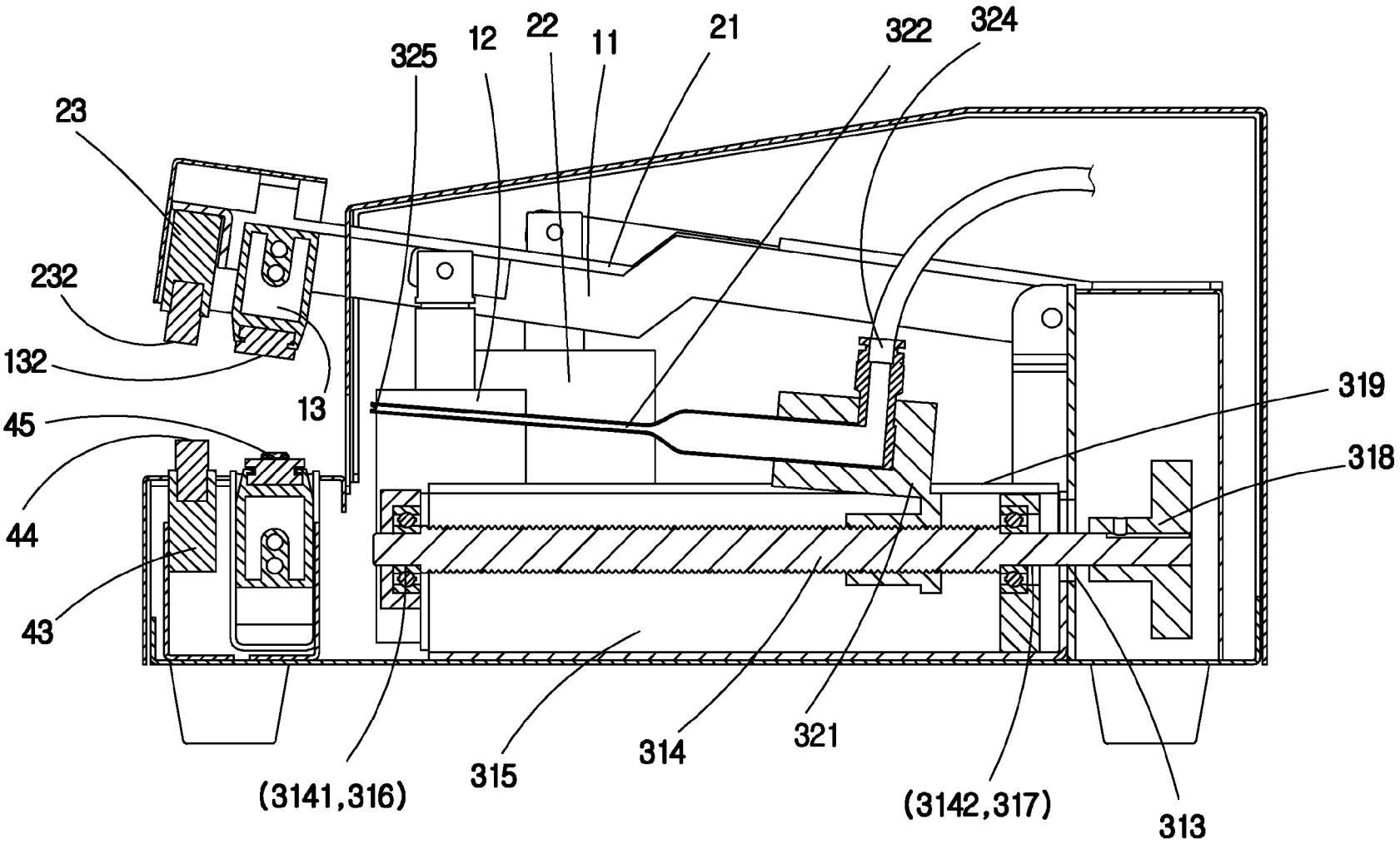
FIG. 6 is a cross sectional view showing the operation of the vacuum sealing machine according to the preferred embodiment of the present invention.
Figure 7:
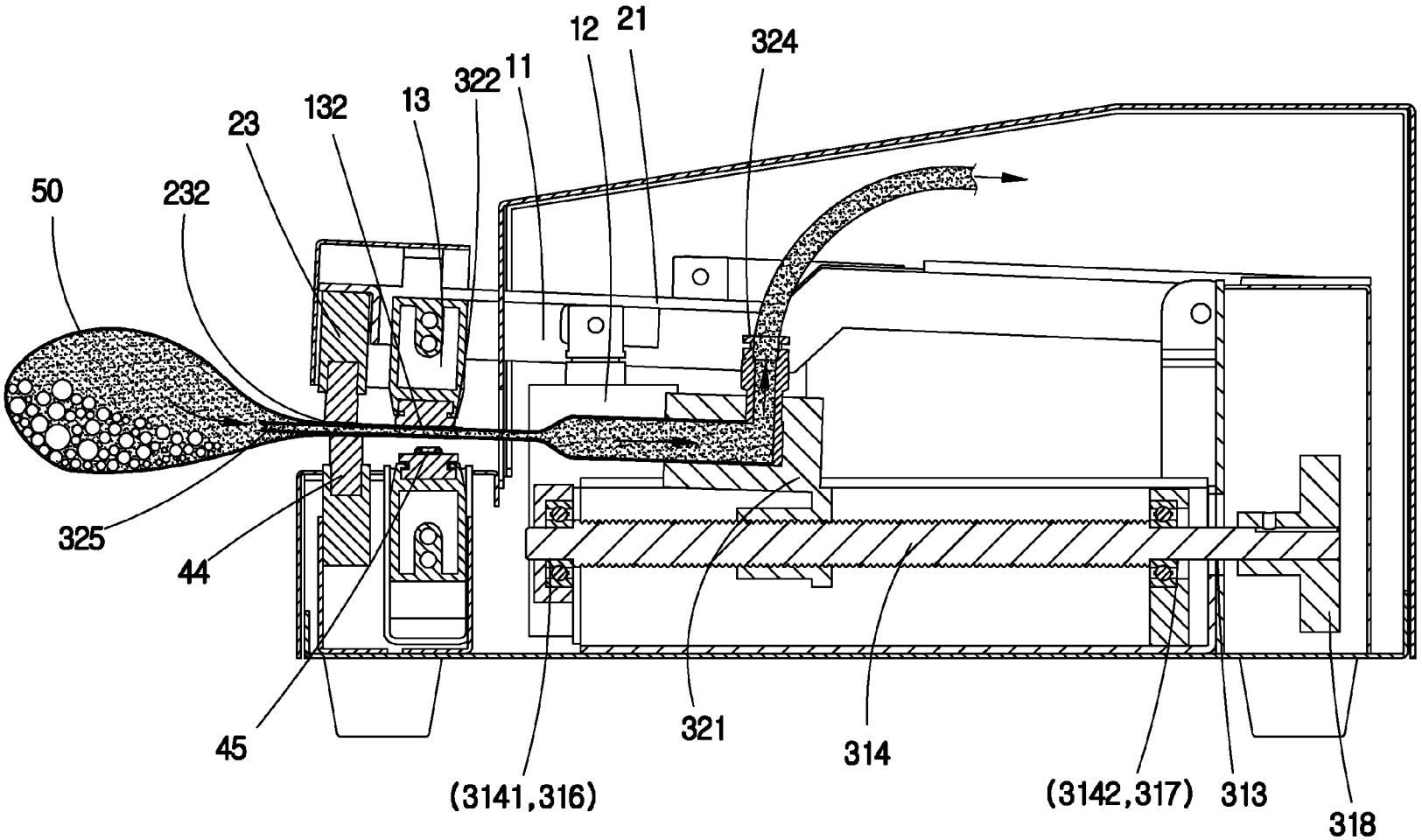
FIG. 7 is another cross sectional view showing the operation of the vacuum sealing machine according to the preferred embodiment of the present invention.
Figure 8:
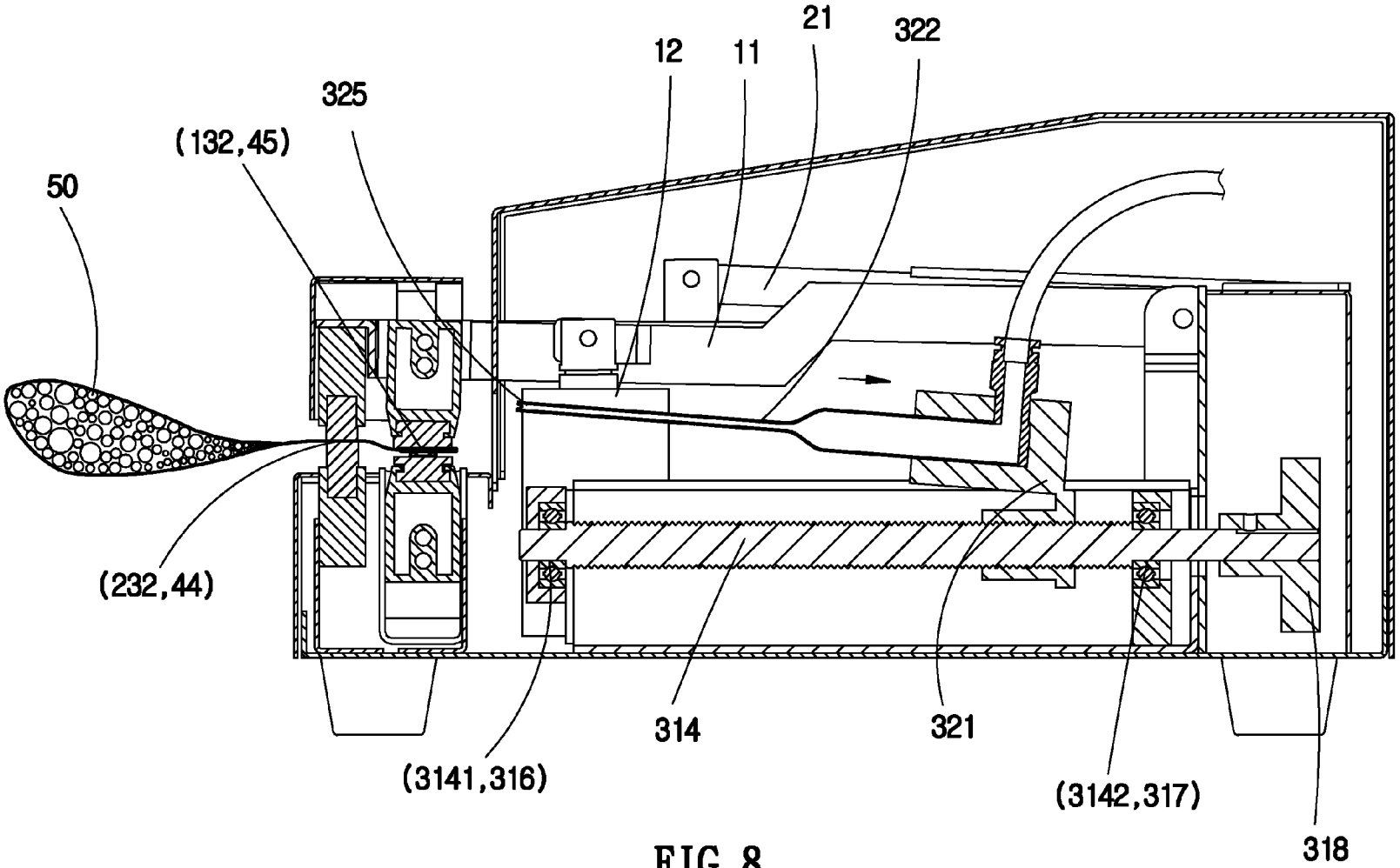
FIG. 8 is also another cross sectional view showing the operation of the vacuum sealing machine according to the preferred embodiment of the present invention.

As illustrated in FIGS. 6-8, in operation, the first press member 13 and the second press member 23 expand, and the drawing device 32 of the air exhausting unit 30 retracts in the body 40 (as shown in FIG. 6) since the transmission device 31 does not operate, and then the closure bag 50 is placed on the barrier strip 44 of the seat 43, thereafter the electric motor 312 of the transmission device 31 is started to drive the gear 318 to rotate, such that the stand 321 is driven by the gear 318 to move forwardly so that the suck tube 322 moves forwardly, and then the intake 325 inserts into the closure bag, the two second electromagnets 22 in the body 40 results an excitation effect from an electricity conductivity, such that the second connecting rod 21 is drawn to move downwardly, and then the second press member 23 moves downwardly to contact with the barrier strip 44 of the seat 43 tightly. After the closure bag is pressed, the drawing device 32 draws the air in the closure bag 50 (as shown in FIG. 7), and after drawing the air in the closure bag 50, the electric motor 312 of the transmission device 31 is started again to drive the gear 318 to rotate, such that the driving post 314 drives the stand 321 to move backwardly, and the drawing device 32 moves out of the closure bag and starts a sealing operation in the vacuum state. After the two first electromagnets 12 initiate the magnetism, the attraction force creates to drive the first connecting rod 11, and then the first press member 13 is drawn downwardly so that the first coupling face 131 presses the heating strip 45 of the seat 43, thus starting the heating and sealing operation (as shown in FIG. 8). Thereafter, the two support tabs 215 of the second connecting rod 21 of the pressing unit 20 support the first connecting rod 11 of the sealing unit 10, hence the pressing unit 20 returns back to the original position and drives the sealing unit 10 to move back to the original position.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A vacuum sealing machine comprising:

a sealing unit including a first connecting rod, a first driving device coupled to the first connecting rod, and a first press member coupled to the first connecting rod, the first connecting rod being formed in a C shape having two first pivot locations respectively defined on two rear ends of two sides thereof, the first press member having a first adhering face defined on a lower end thereof, the first driving device providing power to drive the first press member downward;

a pressing unit including a second connecting rod, a second driving device coupled to the second connecting rod, a second press member coupled to the second connecting rod, the second connecting rod being formed in a C shape and having two second pivot locations respectively disposed on rear sections of two sides thereof and corresponding to the two first pivot locations of the sealing unit, the first connecting rod and the second connecting rod being pivotably connected together via the first and second pivot locations, the second connecting rod also having at least a support tab protruding from the second connecting rod and configured to engage and support the first connecting rod of the sealing unit, the pressing unit driving the sealing unit to return to an original position by lifting up the first connecting rod with the support tab, and the second press member having a second adhering face defined on a lower end thereof, the second driving device providing power to drive the second press member downward;

an air exhausting unit including a transmission device and a drawing device, the transmission device driving the drawing device to move forward and backward; and a body having a holder in which a receiving room is formed so as to receive the sealing unit, the pressing unit, and the air exhausting unit, the receiving room having a seat formed on a front side thereof, the seat having a barrier strip disposed thereon and a heating strip fixed on an inner side thereof parallel to the barrier strip;

wherein the transmission device drives the drawing device forward to move into a position to engage a closure bag, the second press member of the pressing unit moves downward to press the closure bag with the barrier strip, the drawing device draws air from the closure bag, and after drawing the air in the closure bag, the first press member of the sealing unit moves downward to seal and adhere the closure bag in a vacuum state with the heating strip, and the pressing unit returns back to the original position and drives the sealing unit via the support tab to return the original position.

2. The vacuum sealing machine as claimed in claim 1, wherein the transmission device comprises a transmitting portion, an electric motor, a driving post, a pedestal, a gear, and two rails, the transmitting portion having the electric motor disposed therein to drive the driving post, and the pedestal is mounted on the transmitting portion and connects with the gear so that the transmitting portion is defined between the pedestal and the gear, and the pedestal has the two rails parallelly secured thereon.

3. The vacuum sealing machine as claimed in claim 1, wherein the drawing device comprises a stand, a suck tube, two dovetail slots, an outlet, and an intake, wherein the stand is axially mounted on the driving post, has the suck tube disposed on a front side thereof, and has the intake defined on a front end of the suck tube, such that the stand is driven by the driving post to move reciprocatingly.

* * * * *